United States Patent [19]

Schroeder et al.

[11] 4,122,315

[45] Oct. 24, 1978

[54] COMPACT, MULTIPLE-ELEMENT SPEAKER SYSTEM

[75] Inventors: Donald S. Schroeder, Barrington; James F. Novak, La Grange Park, both of Ill.

[73] Assignee: Pemcor, Inc., Westchester, Ill.

[21] Appl. No.: 805,819

[22] Filed: Jun. 13, 1977

[51] Int. Cl.[2] ..... H04R 1/26

[52] U.S. Cl. ..... 179/115.5 PS; 181/147

[58] Field of Search ..... 179/115.5 PS, 116; 181/144, 145, 146, 147, 164, 171

[56] References Cited

U.S. PATENT DOCUMENTS

| | | | |
|---|---|---|---|
| 1,965,405 | 7/1934 | Blattner | 179/115.5 PS |
| 2,053,364 | 9/1936 | Engholm | 179/116 |
| 2,681,390 | 6/1964 | Levi | 179/115.5 ME |
| 2,857,478 | 10/1958 | Harris | 179/116 |

FOREIGN PATENT DOCUMENTS

| | | | |
|---|---|---|---|
| 531,694 | 3/1955 | Belgium | 181/144 |
| 844,170 | 7/1952 | Fed. Rep. of Germany | 179/115.5 PS |

*Primary Examiner*—George G. Stellar
*Attorney, Agent, or Firm*—Darbo & Vandenburgh

[57] ABSTRACT

A compact, multiple-element, high-fidelity speaker system for use in confined areas has electrically independent woofer, mid-range and tweeter elements mounted on a common frame with the mid-range and tweeter elements disposed in the conical volume of the woofer cone. Recesses in the woofer cone provide clearance for the drivers of the mid-range and tweeter elements.

9 Claims, 9 Drawing Figures

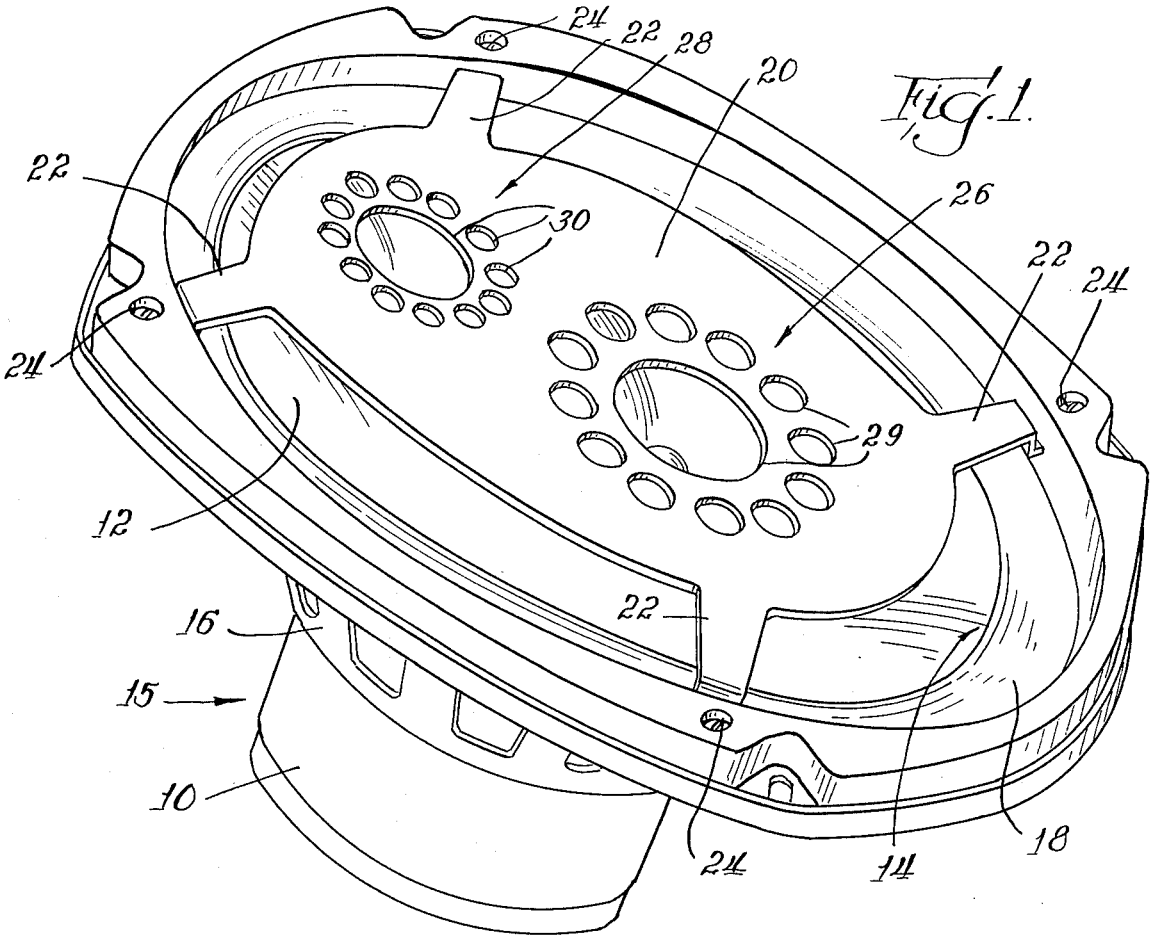
Fig. 1.
Fig. 2.
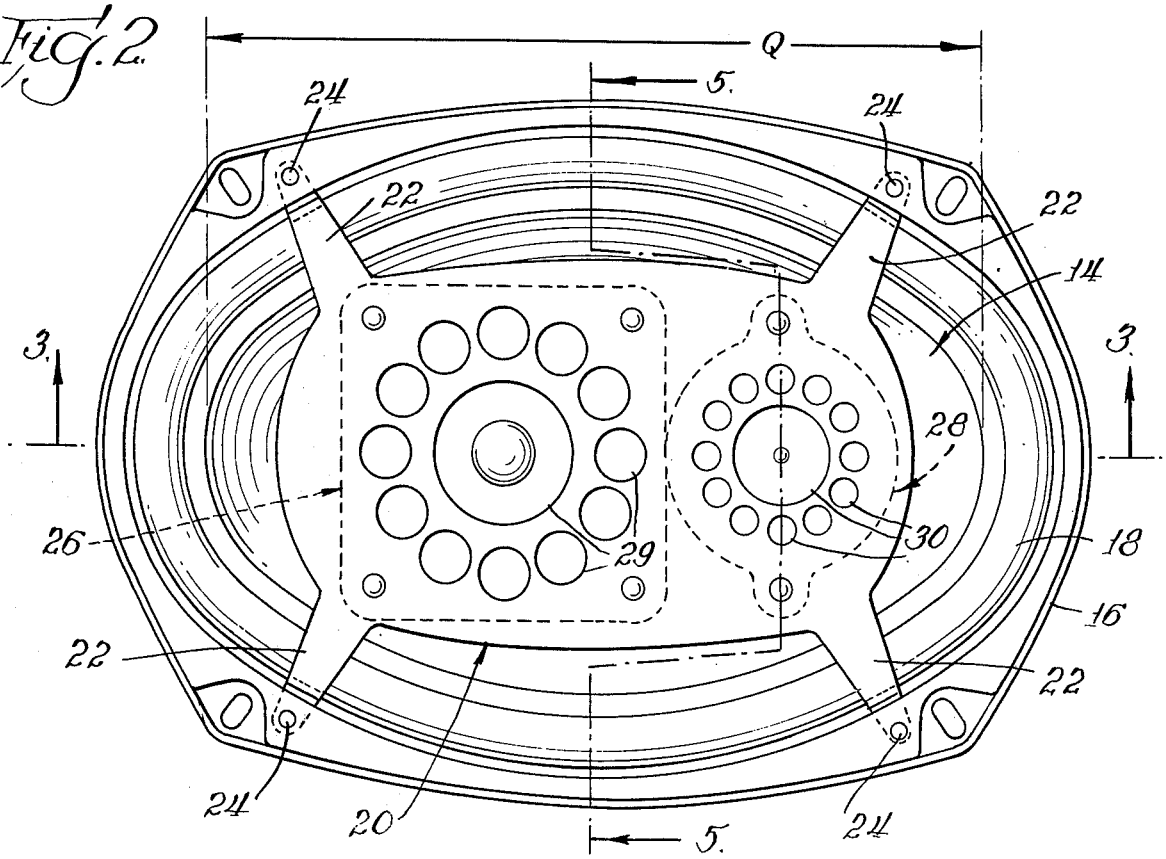

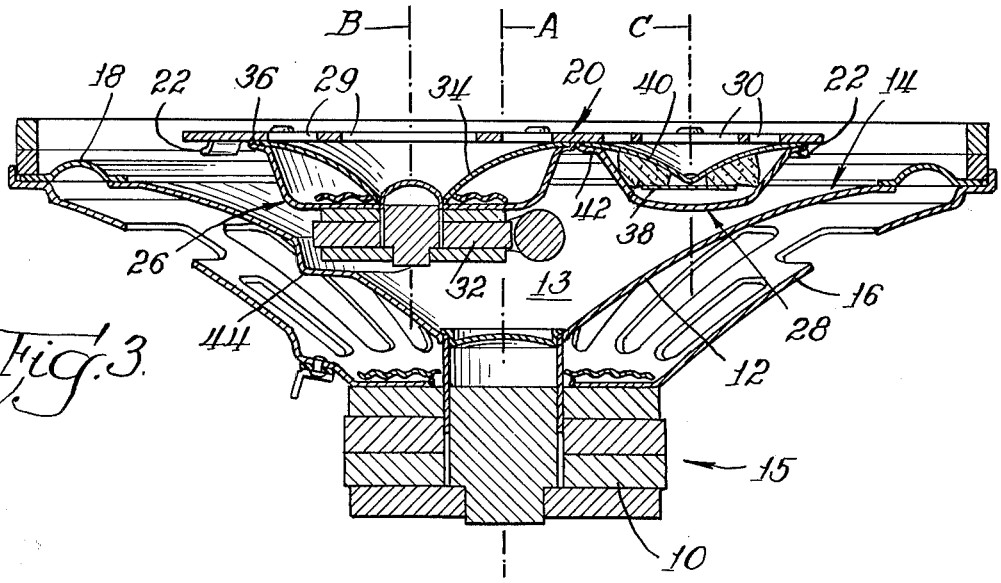
Fig. 3.
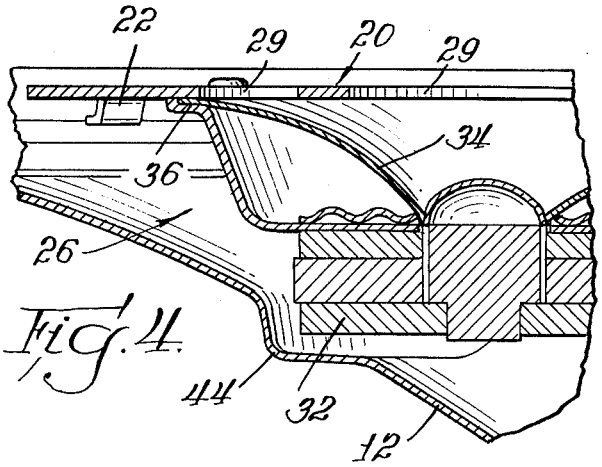
Fig. 4.
Fig. 4A.
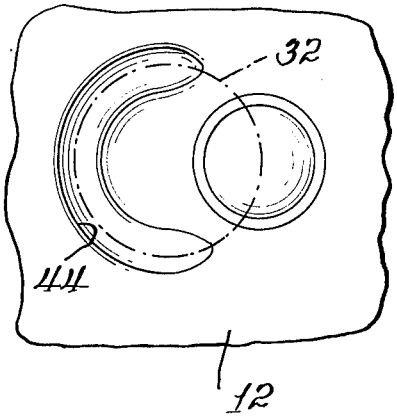
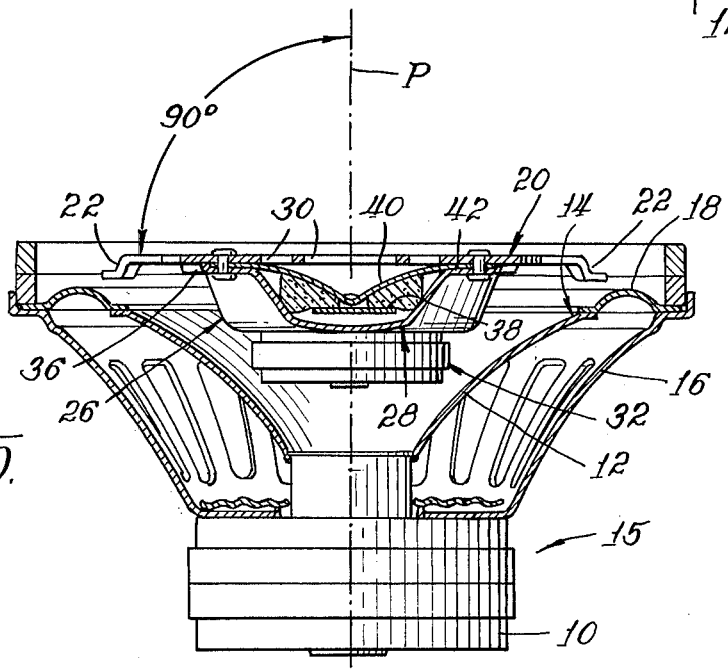
Fig. 5.

Fig. 6.
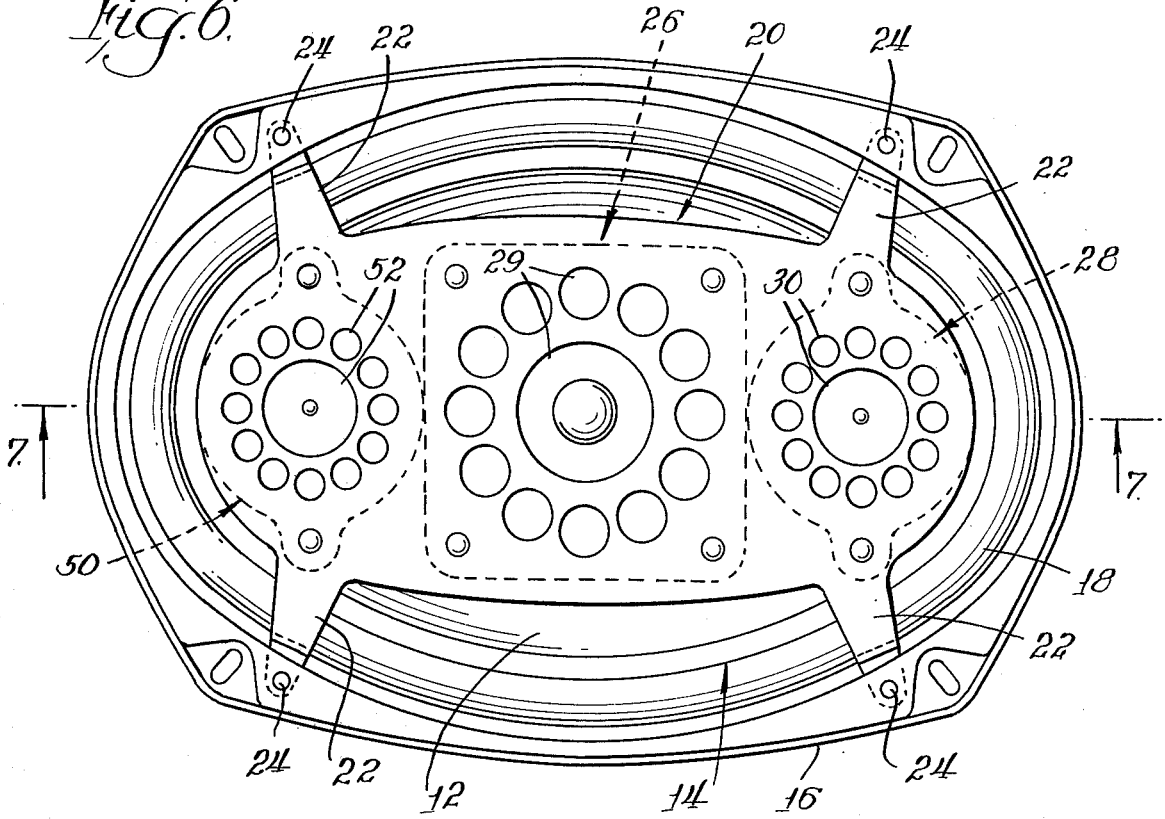
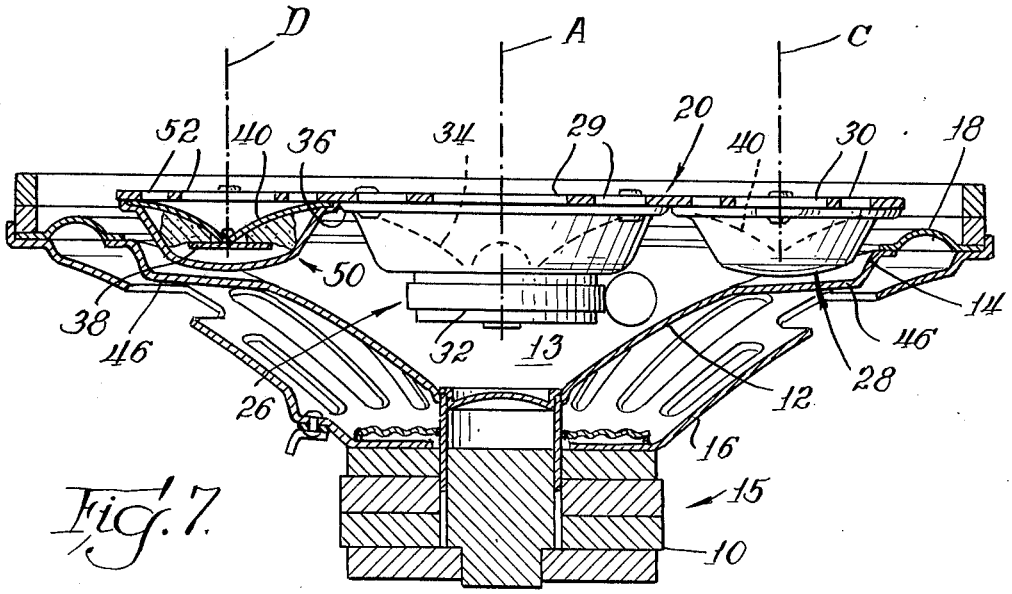
Fig. 7.

COMPACT, MULTIPLE-ELEMENT SPEAKER SYSTEM

BACKGROUND OF THE INVENTION

The increase in use of high quality audio equipment in automobiles and the like has generated a need for high-performance speaker systems which provide a substantially level audio signal for the full sound spectrum discernible by the human ear.

It is known that single cone speaker systems do not reproduce the minimum high-fidelity frequency range of 40 to 15,000 Hz with adequate smoothness of response, freedom from distortion, or power handling capacity. Because low frequency reproduction dictates the use of large, heavy cones, while high frequency reproduction requires the use of small, light-weight cones, it is possible to combine two such cones in one speaker drive mechanism, so that the low and middle frequencies will be reproduced by the large cone and the high frequencies will be radiated from the smaller cone. The two cone speakers are superior to the single cone system.

Although two cone systems represent a significant improvement in performance, they are still prone to special types of distortion known as intermodulation, or "Doppler" distortion. Because the middle and high frequencies (where the ear is most sensitive to distortion) are still being reproduced by the same drive mechanism which generates the low frequencies, the low frequencies tend to modulate or affect the frequency of the middle and high frequencies.

The low frequency modulation problem is solved by splitting the audio frequency spectrum into two parts and then reproducing each half with a speaker element designed just for that portion of the high-fidelity spectrum. It is known to mount two electrically independent speakers of this type on a common frame with the speaker elements coaxial. The coaxial speaker systems provide improved sound reproduction when compared to the dual cone design; however, since the middle range of frequencies is still mainly reproduced by the low frequency speaker, Doppler distortion and lack of suitable mid-range clarity still results.

It is known to further split the audio frequency spectrum into three parts with the low-range speaker element producing only the lowest end of the sound spectrum, the high-range speaker element specifically adapted for reproducing only the high end of the spectrum and a mid-range speaker for reproducing only the mid-range portion of the frequency spectrum, thereby substantially minimizing the Doppler distortion while increasing the mid-range clarity.

Early three-element speaker systems having three electrically independent driver and speaker elements were adapted for home and professional use and were large systems mounted on the three independent frames within a single enclosure. This was later replaced by a three-element speaker system wherein the three independent electrical driver and speaker elements are mounted on a common frame. These units are also intended for home entertainment and professional applications, and are quite large and heavy. Yet, the improved quality of sound reproduction produced by the three element speaker systems make them highly desirable despite their overall size and weight.

The evolution of compact speaker systems for use in automobiles and the like has recently very closely paralleled that of home high-fidelity speaker systems of years ago. Basic features such as specially molded speaker cones, large magnetic driver structures, high compliance suspension systems and high temperature voice coils, which are known to offer improved performance in home high-fidelity speakers have now been successfully introduced into compact speaker design. In addition, coaxial two-element speaker systems having electrically independent low-range and high-range elements mounted on a single frame are now available in compact systems for use in automobiles and the like.

It would seem logical that a three or more element compact speaker system for use in automobiles would provide improved quality of sound reproduction over the coaxial speaker for automobile systems just as it did in home and professional entertainment systems. However, the designing of such multiple-element speaker systems for automobiles presented a host of technological problems not soluble by known expedients. The speakers have to reproduce the frequency spectrum normally found in home or professional stereo speaker systems with the same quality and at the same time remain compact and be designed to fit within those spaces provided by automobile manufacturers. These problems are overcome by the present invention.

SUMMARY OF THE INVENTION

The multiple-element, high-fidelity, compact speaker system of the present invention has a low-range frequency element, a mid-range frequency element and a high-range frequency element, all mounted in a single framework to provide a high quality speaker system which is responsive to electrical signals to produce a substantially level audio signal over the entire high-fidelity sound spectrum (20–20,000 Hz). The low-range frequency element or "woofer" is mounted in a circumferential support frame and defines a substantially conical volume. An auxiliary support frame transversely spans the conical volume defined by the cone of the woofer and is supported by the circumferential support frame. The mid-range frequency element and the high-range frequency element or "tweeter" are mounted on the transverse frame and depend from the frame downwardly into the conical volume of the woofer cone. The respective axes of the elements are parallel and in the preferred embodiment define a common plane which include the major axis of the oval woofer cone. A modification of the invention is provided wherein the system includes a woofer, a mid-range element, and a plurality of tweeters coupled in parallel.

It has been found that a depression or recess can be formed in the woofer cone to provide additional clearance between the cone and the drivers for the mid-range and the high-range frequency elements without impairing the quality of the sound produced by the low frequency woofer. This permits the various elements of the system to be closely spaced along the system central axis, thereby decreasing the overall size of the system while increasing the phasing balance between the elements.

The present invention provides a high-fidelity, compact speaker system having low, mid and high-range elements housed in a single framework with the "tweeter" and mid-range elements mounted in side-by-side relationship within the volume defined by the woofer cone. This provides an increased overall sound quality of the speaker system over known compact systems without increasing the overall size. The quality of the output produced by the speaker system according to the present invention exceeds that of known coaxial speaker systems, particularly in the combined range covering the middle and high frequencies of the sound spectrum. These frequencies were previously reproduced by a single speaker element which could not be as responsive as the two independent mid-range and high-range elements of the present invention.

BRIEF DESCRIPTION OF THE DRAWINGS

FIG. 1 is a perspective view of a compact speaker system according to the present invention.

FIG. 2 is a plan view of the system of FIG. 1

FIG. 3 is a section view taken on line 3—3 of FIG. 2.

FIG. 4 is an enlarged, partial section view looking in the direction of FIG. 3.

FIG. 4*a* is a partial plan view of a woofer cone having an integral recess therein.

FIG. 5 is a section view taken at line 5—5 of FIG. 2.

FIG. 6 is a plan view of a modified embodiment of the present invention.

FIG. 7 is a section view taken generally at line 7—7 of FIG. 6.

DESCRIPTION OF THE PREFERRED EMBODIMENTS

Figure 8:
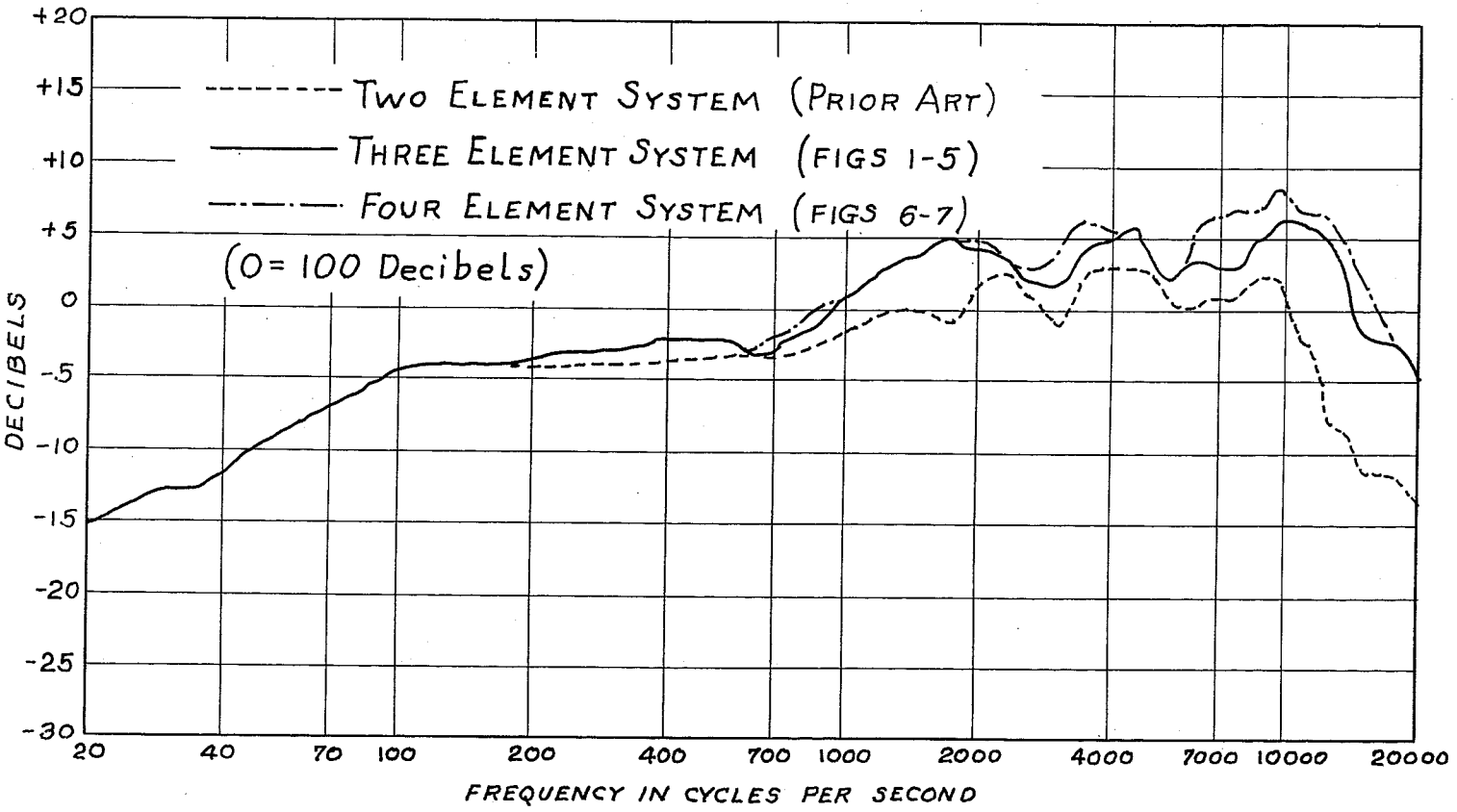
FIG. 8 is a composite frequency response chart illustrating the output of the compact speaker assemblies of the present invention compared with the speaker systems of the prior art for the high-fidelity sound spectrum of 20–20,000 Hz.

The speaker system is shown in perspective in FIG. 1. The base of the assembly is formed by a low-range responsive motor 10 which, in the embodiment illustrated, is a permanent magnet. A substantially conical diaphragm or cone 12 is mounted on the driver 10 and diverges outwardly therefrom, terminating in an oval or substantially elliptical periphery 14. The driver 10 and cone 12 comprise the low-range or "woofer" 15 of the speaker system which is specifically adapted to respond to low frequency signals in the range of 20 to 2000 Hz.

A rigid frame 16 is supported by driver 10 and projects outwardly and upwardly therefrom, completely circumscribing the woofer cone 12. The frame is ported to provide adequate freedom of air movement with respective to the woofer cone, permitting the cone to vibrate with minimum restriction in response to vibration of the driver. The elliptical periphery 14 of the cone is secured to the frame 16 in a substantially free, suspended relationship by the continuous, highly compliant membrane 18.

The frame 16 is normally constructed of metal for the rigid support of the speaker assembly. An auxiliary support frame 20 substantially spans the periphery 14 of the cone just outwardly thereof to define with woofer cone 12 a conical volume 13. The transverse frame 20 includes a plurality of mounting tabs 22 (FIG. 2) which radiate outwardly from the circumference of the frame for securing the transverse frame 20 on the circumferential frame 16 by suitable means such as the screws 24. The mid-range element 26 and high-range "tweeter" element 28 are mounted in sideby-side relationship on transverse frame 20 and depend therefrom into the conical volume 13. The transverse frame 20 is ported at 29 and 30 to permit the audio signals reproduced by the mid-range and tweeter elements to emanate outwardly from the frame in the same direction as the audio signals which are produced by the woofer cone 12.

As shown in FIG. 3, the mid-range element 26 includes an independent driver 32 and a substantially conical diaphragm or cone 34 mounted on and projecting upwardly from the driver and terminating in a substantially circular periphery 36 adjacent the undersurface of transverse frame 20. In the preferred embodiment, the mid-range driver comprises a permanent magnet. Tweeter element 28 also includes an independent driver 38 and a substantially conical cone 40 which terminates in a substantially circular periphery 42 adjacent the undersurface of transverse frame 20. In the preferred embodiment, a piezoelectric driver is selected for the tweeter element because of its small size and light weight. The mid-range element 26 is designed to specifically respond to audio signals in the middle of the sound spectrum, i.e., 2000 to 7000 Hz. The tweeter element 28 is designed to respond to audio signals at the high end of the spectrum, i.e., 7000 to 20,000 Hz. Thus, the woofer, mid-range and tweeter elements collectively provide a speaker system which is responsive to the entire high fidelity sound spectrum of 20–20,000 Hz.

The precise placement of the various elements in the compact speaker system will be more readily understood by referring to the geometric configuration of the elements. The woofer cone 12 defines a system central axis A as shown in FIG. 3. The mid-range cone 34 defines a mid-range element axis B, and the axis of the tweeter cone 40 defines the tweeter axis C. The axes of all three cones are parallel, and in the preferred embodiment all three axes intersect the major diameter Q and the three axes A, B and C define a common plane P which bisects all of the cones of the speaker system, as shown in FIG. 5.

In the three-element system of FIGS. 1–5, the axis B of the mid-range element 26 is offset from the central axis A, and the axis C of the tweeter element is disposed on the opposite side of the central axis A. When the speaker elements are arranged in this manner no appreciable loss of quality of the sound emanating from the woofer element is experienced.

With this arrangement of speaker elements, it is desirable that the axial distance between drivers be kept at a minimum in order to achieve acceptable audio phasing between elements. It has been found that additional clearance between the magnet assembly 32 of the mid-range element 26 and the woofer cone 12 may be provided by forming an integral recess or depression 44 in the woofer cone (FIGS. 4 and 4*a*) without resulting in loss of quality of output by the woofer. This recess provides ample clearance between the woofer cone 12 and the magnet assembly 32 during longest excursions of the cone. The recess is molded into the cone during manufacture. In the preferred embodiment, the woofer cone is a molded, continuous paper structure and the recess is part of the cone mold.

Additional quality of response is achieved with the four-element speaker system illustrated in FIGS. 6 and 7. As there shown, the mid-range element 26 is coaxial with the woofer element and a pair of tweeter elements 28 and 50 are employed. The tweeter elements 28 and 50 are similar in design, each having a piezoelectric driver 38, a cone 40 having a substantially circular periphery 42 disposed adjacent the underside of frame 20. The mid-range element 26 and the tweeter elements 28 and 50 are mounted on frame 20 are depend downwardly therefrom into the conical volume 13 defined by woofer cone 12. Tweeter elements 28 and 50 are coupled in parallel and thereby boost the output at the high end of the frequency spectrum, i.e., ranging from 7000 to 20,000 Hz. This permits the output of the mid-range element 26 to also be increased, resulting in an improved overall response of the system, particularly at the middle and high ends of the sound spectrum.

The transverse frame 20 is ported at 29, 30 and 52 as shown in FIG. 6, and provides adequate open space for releasing the audio signals produced by the mid-range and tweeter elements. The transverse frame 20 is practically identical to the frame utilized in the three-element embodiment of FIGS. 1–5 and no appreciable loss of quality of the sound produced by the woofer is experienced when the four-element system is employed.

In the embodiment of FIGS. 6 and 7, the axes C and D of the tweeter elements 28 and 50, respectively, intersect the major diameter Q of the oval woofer periphery and are parallel to the system central axis A. The tweeters are diametrically opposed and equally spaced from the mid-range element 26, which is coaxial with the woofer and central axis A.

In order to provide adequate clearance between the woofer cone 12 and the tweeter drivers 38, recesses 46 are provided in the cone. Again, it has been found that these recesses have no appreciable adverse effect on the quality of the audio signals produced by the woofer.

The assignee of the present invention has produced a commerical embodiment of the three-element system illustrated in FIGS. 1–5, wherein the oval periphery of the woofer is 6 inches by 9 inches. This will permit the transverse frame to be large enough to adequately support a 3 inches circular mid-range element and a 2 inches tweeter element. The woofer and mid-range driver magnets are barrium-ferrite, ceramic permanent magnets, and the tweeter is driven by a piezoelectric disk element. The ceramic magnet is peculiarly useful for driving the mid-range element in the compact assembly of the invention since it can be constructed in a shallow ring configuration, thereby maximizing the clearance between the mid-range driver and the woofer cone. The piezoelectric tweeter driver is also advantages because of its relatively small size. The cones are all of a continuous, molded paper construction.

FIG. 8 shows a typical frequency response curve for this speaker system, as well as for a prior art two-element system also having a 6 inches by 9 inches oval woofer, and a four-element system having the same specifications as the commercial three-element system with the exception that two limited range tweeters are employed. The vertical scale of the chart represents the decibel response level of the system and the horizontal scale embraces the entire high-fidelity frequency spectrum from 20 to 20,000 Hz. The zero point on the decibel scale represents an output response to 100 decibels at two feet. It will be seen that the low-range woofer response of all three systems is identical. However, a significant improvement over the two-element system is experienced in the mid-range frequencies 2000 to 7000 Hz and the high-range frequencies 7000 to 20,000 Hz when the three-element system is employed. An even better high-range response is achieved when two parallel tweeter elements are employed.

The present invention provides a compact, high-fidelity multiple-element speaker system having woofer, mid-range and tweeter elements for use in confined areas such as the spaces provided by manufacturers in automobiles or the like. The speaker system compares favorably with the multiple-element systems now in use in home and professional entertainment systems, and provides a substantial improvement over the quality of known compact speaker systems. While certain embodiments of the invention have been illustrated herein, it should be understood that modifications and alterations may be made without departing from the scope and spirit of the invention as defined by the appended claims.

What is claimed is:

1. An improvement in a compact, multiple-element high-fidelity speaker system, each element including an independent driver and a limited frequency range speaker cone associated with the river, the plurality of elements collectively providing a speaker system which is responsive to electrical signals to produce a substantially level audio signal over the high-fidelity sound spectrum, the system being of the type having a circumferential support frame having a central axis, a low-range frequency responsive cone and driver element supported by and mounted in coaxial relationship with the circumferential support frame, and a transverse support frame supported by the circumferential support frame at right angles to and intersecting the central axis, said transverse support frame with said low-range cone defining a generally conical volume but leaving a gap between said frame and said cone, the improvement comprising:

a. A mid-range frequency responsive cone and driver element mounted on said transverse frame within said conical volume on an axis parallel to said central axis, and b. a high-range frequency responsive cone and driver element mounted on said transverse frame adjacent said mid-range cone and driver within said conical volume on an axis parallel to said central axis, c. said low-range element cone having a generally conical diaphragm, said diaphragm having therein at least one integral recess for ensuring clearance at all times between said diaphragm and at least one of said drivers, d. said transverse frame being ported at the mouths of said mid-range and said high-range cones.

2. The speaker system of claim 1 which includes a second high-range element mounted on said transverse support frame having a cone axis parallel to said central axis, said first mentioned and said second high-range elements being disposed one each on opposite sides of said mid-range element.

3. The system of claim 1 wherein said mid-range element is disposed between said central axis and said diaphragm, and wherein said recess defines a mid-range driver-receptive pocket in the said diaphragm.

4. The system of claim 1 and including a plurality of high-range elements wherein said mid-range element is located between said plurality of high-range elements which are each disposed between the said mid-range element and said diaphragm, said diaphragm having a plurality of recesses in one-to-one associated relationship with the high-range elements, defining in said diaphragm an element-receptive pocket therefor.

5. The speaker system of claim 1, wherein said low-range cone has a substantially elliptical periphery and wherein said recess is located at the intersection of the common plane defined by said central axis an the major diameter of said periphery with said cone.

6. The speaker system of claim 1, wherein said high-range element driver is a piezoelectric crystal, and wherein said mid-range element driver is a ceramic permanent magnet.

7. The speaker system of claim 1, wherein said central axis and the respective axes of said elements mounted on said transverse support frame lie in a common plane.

8. The speaker system of claim 7, wherein said low-range frequency cone has a substantially elliptical periphery with its major diameter in the said common plane.

9. The speaker system of claim 8, wherein said mid-range cone and said high-range cone are on opposite sides of said central axis.

* * * * *

UNITED STATES PATENT AND TRADEMARK OFFICE

CERTIFICATE OF CORRECTION

PATENT NO. : 4,122,315

DATED : October 24, 1978

INVENTOR(S) : Donald S. Schroeder and James F. Novak

It is certified that error appears in the above-identified patent and that said Letters Patent are hereby corrected as shown below:

| | |
|---|---|
| Col. 3, l. 13 | No period after "FIG. 1" |
| Col. 3, l. 46 | "respective" should be --respect-- |
| Col. 3, l. 62 | "sideby" should be --side-by-- |
| Col. 4, l. 65 | "are" second occurrence should be --and-- |
| Col. 5, l. 40 | "advantage" should be --advantageous-- |
| Col. 5, l. 53 | "to" should be --of-- |
| Col. 6, l. 12 | "river" should be --driver-- |
| Col. 6, l. 63 | "an" should be --and-- |

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*